US008953972B2

(12) United States Patent
Izawa et al.

(10) Patent No.: US 8,953,972 B2
(45) Date of Patent: Feb. 10, 2015

(54) TRANSFER ROLLER CLEANING APPARATUS AND ELECTRONIC PHOTOGRAPH PRINTER

(71) Applicant: Miyakoshi Printing Machinery Co., Ltd., Narashino (JP)

(72) Inventors: Hideo Izawa, Narashino (JP); Junichi Setoyama, Narashino (JP); Kenji Takahashi, Narashino (JP); Kazuhiko Satou, Yokote (JP)

(73) Assignee: Keihin Corporation (JP)

( * ) Notice: Subject to any disclaimer, the term of this patent is extended or adjusted under 35 U.S.C. 154(b) by 87 days.

(21) Appl. No.: 13/675,093

(22) Filed: Nov. 13, 2012

(65) Prior Publication Data

US 2013/0129374 A1 May 23, 2013

(30) Foreign Application Priority Data

Nov. 18, 2011 (JP) ..... 2011-252853

(51) Int. Cl.
*G03G 15/16* (2006.01)

(52) U.S. Cl.
CPC ..... *G03G 15/161* (2013.01); *G03G 15/168* (2013.01); *G03G 2215/1652* (2013.01)
USPC ..... 399/101

(58) Field of Classification Search
CPC ..... G03G 15/161; G03G 15/168
USPC ..... 399/101, 348
See application file for complete search history.

(56) References Cited

U.S. PATENT DOCUMENTS

| | | | | |
|---|---|---|---|---|
| 5,596,398 | A | 1/1997 | Woo et al. | |
| 2004/0234309 | A1 * | 11/2004 | Nagata et al. | 399/348 |
| 2009/0169238 | A1 * | 7/2009 | Izawa et al. | 399/101 |
| 2010/0124431 | A1 * | 5/2010 | Izawa et al. | 399/101 |
| 2012/0294653 | A1 * | 11/2012 | Gomi et al. | 399/249 |

FOREIGN PATENT DOCUMENTS

| | | | |
|---|---|---|---|
| EP | 1473602 | A1 | 11/2004 |
| EP | 2187269 | A2 | 5/2010 |
| JP | 63-298384 | A | 12/1988 |
| JP | 8-110707 | A | 4/1996 |

(Continued)

OTHER PUBLICATIONS

Extended European Search Report; Application No. 12192455.9; Date of Mailing: Mar. 7, 2013.

(Continued)

*Primary Examiner* — Walter L Lindsay, Jr.
*Assistant Examiner* — Rodney Bonnette
(74) *Attorney, Agent, or Firm* — Cantor Colburn LLP

(57) ABSTRACT

Provided are a transfer roller cleaning apparatus that has a supply roller that is immersed in the carrier liquid in a carrier liquid vessel; a cleaning roller that is rubbed and rotated on the supply roller and the transfer roller, and supplies the carrier liquid received from the supply roller to a surface of the transfer roller; and a carrier liquid circulation device which includes the carrier liquid vessel, supplies the carrier liquid in a storage tank to the carrier liquid vessel using a pump, and sends the carrier liquid overflowed from the carrier liquid vessel back to the storage tank via an overflow liquid recovery path, so as to constitute a carrier liquid circulation path and an electronic photograph printer configured by providing the same.

20 Claims, 3 Drawing Sheets

(56) References Cited

FOREIGN PATENT DOCUMENTS

| | | | |
|---|---|---|---|
| JP | 9-114340 | A | 5/1997 |
| JP | 11-512843 | A | 11/1999 |
| JP | 2010-122252 | A | 7/2000 |
| JP | 2002-202669 | A | 7/2002 |
| JP | 2003-233258 | A | 8/2003 |
| JP | 2005-77632 | A | 3/2005 |
| JP | 2008-102319 | A | 5/2008 |
| JP | 2009-157179 | A | 7/2009 |
| JP | 2009-198578 | A | 9/2009 |

OTHER PUBLICATIONS

Notice of Reasons for Rejection for Japanese Application No. 2011-252853, mailed Oct. 21, 2014, with English translation.

* cited by examiner

TRANSFER ROLLER CLEANING APPARATUS AND ELECTRONIC PHOTOGRAPH PRINTER

BACKGROUND OF THE INVENTION

1. Field of the Invention

The present invention relates to a transfer roller cleaning apparatus that cleans a transfer roller of a wet type electrophonic photograph printer that transfers a toner image which is formed on an outer peripheral surface of a photosensitive drum onto a printing surface of a recording target medium via the transfer roller using a developer consisting of a liquid toner and a carrier liquid to print images, and to an electronic photograph printer that is provided with the transfer roller cleaning apparatus. Priority is claimed on Japanese Patent Application No. 2011-252853, filed on Nov. 18, 2011, the content of which is incorporated herein by reference.

2. Description of Related Art

In the wet type electronic photograph printer that transfers a toner image which is formed on an outer peripheral surface of a photosensitive drum onto a printing surface of a recording target medium (paper) via the transfer roller using the developer consisting of the liquid toner and the carrier liquid to print images, a technique is widely adopted which is provided with a cleaning blade that scrapes out residual toner on the transfer roller surface in order to remove the residual toner of the transfer roller surface after transferring the image onto the recording target medium.

Furthermore, for example, Japanese Unexamined Patent Application, First Publication No. 2010-122252 also discloses an apparatus (an electronic photograph printer) that is provided with a carrier liquid supply device that supplies the carrier liquid to the transfer roller surface so as to effectively remove the residual toner from the transfer roller surface, and a cleaning apparatus having a cleaning roll that is rotated adjacent to the transfer roller surface, and adsorbs and recovers the residual toner from the transfer roller surface by being applied with bias voltage of the opposite polarity to the residual toner of the transfer roller surface.

The apparatus (the electronic photograph printer) of the related art disclosed in Japanese Unexamined Patent Application, First Publication No. 2010-122252 has a configuration in which a carrier liquid supply device and a cleaning apparatus serving as separately independent units are provided so as to be separated from each other in a circumferential direction of the transfer roller. For this reason, although a satisfactory cleaning effect is obtained in the apparatus of the related art, a relatively large space is necessary for installing the carrier liquid supply device and the cleaning apparatus. Furthermore, two devices (the carrier liquid supply device and the cleaning apparatus) are necessary. For this reason, it is difficult to reduce the manufacturing cost of the device, various work such as operation and maintenance, and the control thereof are complicated, and thus an improvement is required.

Since the apparatus (the electronic photograph printer) of the related art has a configuration in which the residual toner is dissolved in the carrier liquid applied to the transfer roller surface using the carrier liquid supply device, and the residual toner is recovered together with the carrier liquid using the cleaning apparatus, there was a problem in that the consumption of the carrier liquid is high.

The present invention was made in view of the above circumstances, and an object thereof is to provide a transfer roller cleaning apparatus and an electronic photograph printer that is easy to operate, maintain, and control, that utilizes a small space and operates at a reduced cost, and that consumes less carrier liquid.

SUMMARY OF THE INVENTION

The present invention provides the configuration as below.

According to a first aspect related to the present invention, there is provided a transfer roller cleaning apparatus that cleans a transfer roller of a wet type electronic photograph printer that uses developer consisting of a liquid toner and a carrier liquid, the apparatus including a supply roller that is immersed in the carrier liquid in a carrier liquid vessel; a cleaning roller that is rubbed and rotated on the supply roller and the transfer roller and that supplies the carrier liquid received from the supply roller to a surface of the transfer roller; and a carrier liquid circulation device which includes the carrier liquid vessel, supplies the carrier liquid in a storage tank to the carrier liquid vessel using a pump, and sends the carrier liquid that is overflowed from the carrier liquid vessel back to the storage tank via an overflow liquid recovery path so as to constitute a carrier liquid circulation path.

According to a second aspect related to the present invention, the transfer roller cleaning apparatus of the first aspect may further include a drainage recovery doctor blade that is placed further to the downstream side of the cleaning roller in a rotation direction than a contact portion between the cleaning roller and the transfer roller so that a leading end portion thereof comes into contact with the cleaning roller; and a drainage path that guides the recovery liquid recovered from the cleaning roller using the drainage recovery doctor blade to a drainage tank placed outside the electronic photograph printer via a recovery liquid discharging path that is provided independently from a carrier liquid storage groove inside of the carrier liquid vessel.

According to a third aspect related to the present invention, the transfer roller cleaning apparatus of the second aspect may further include a side doctor blade that is provided in contact with an end surface of the cleaning roller in an axial direction, recovers the carrier liquid attached to the end surface of the cleaning roller in the axial direction and guides the carrier liquid into the recovery liquid discharging path.

According to a fourth aspect related to the present invention, in the transfer roller cleaning apparatus of one of the first to third aspects, the pump of the carrier liquid circulation device and the storage tank may be placed outside the electronic photograph printer, and at a location of the carrier liquid circulation device located outside the electronic photograph printer, a filter may be provided that removes contaminants from the carrier liquid flowing through the carrier liquid circulation path.

According to a fifth aspect related to the present invention, the transfer roller cleaning apparatus of one of the first to fourth aspects may further include a cassette that is configured by providing the supply roller, the cleaning roller, the carrier liquid vessel, and an overflow liquid storing portion that causes the carrier liquid overflowed from the carrier liquid vessel in the overflow liquid recovery path to flow in a cassette frame, and is attached to a body of the electronic photograph printer in an attachable and detachable manner, and a cassette side flow path portion of the carrier liquid circulation device provided in the cassette and an external flow path portion located outside the cassette may be connected to each other using a one-touch coupler in an attachable and detachable manner.

According to a sixth aspect related to the present invention, in the transfer roller cleaning apparatus of one of the first to fifth aspects, when a peripheral speed of the transfer roller is set to 100, the peripheral speed of the cleaning roller that is rotated with the transfer in a forward direction may be 25 to 40, and when a peripheral speed of the cleaning roller is set to 100, the peripheral speed of the carrier liquid supply roller that is rotated with the cleaning roller in the forward direction may be 60 to 80.

According to a seventh aspect related to the present invention, there is provided an electronic photograph printer that has the transfer roller cleaning apparatus of one of the first to sixth aspects.

According to the present invention, it is possible to perform the supply of the carrier liquid to the transfer roller and the recovery of the residual toner from the transfer roller surface using one transfer roller cleaning apparatus. For this reason, in the transfer roller cleaning apparatus related to the present invention, compared to a configuration that requires two apparatuses (the carrier liquid supply device and the cleaning apparatus) as in Japanese Unexamined Patent Application, First Publication No. 2010-122252, the operation, the maintenance and the control thereof are easy, and a space saving and cost reduction can be easily realized.

According to the present invention, since the transfer roller cleaning apparatus is able to recover the residual toner from the transfer roller surface, by supplying the carrier liquid to the contact portion between the transfer roller and the cleaning roller that is rubbed on the transfer roller using the cleaning roller, it is possible to suppress an amount of consumption of the carrier liquid compared to the technique disclosed in Japanese Unexamined Patent Application, First Publication No. 2010-122252.

DETAILED DESCRIPTION OF THE INVENTION

Hereinafter, a first embodiment of the present invention will be described with reference to the drawings.

Figure 1:
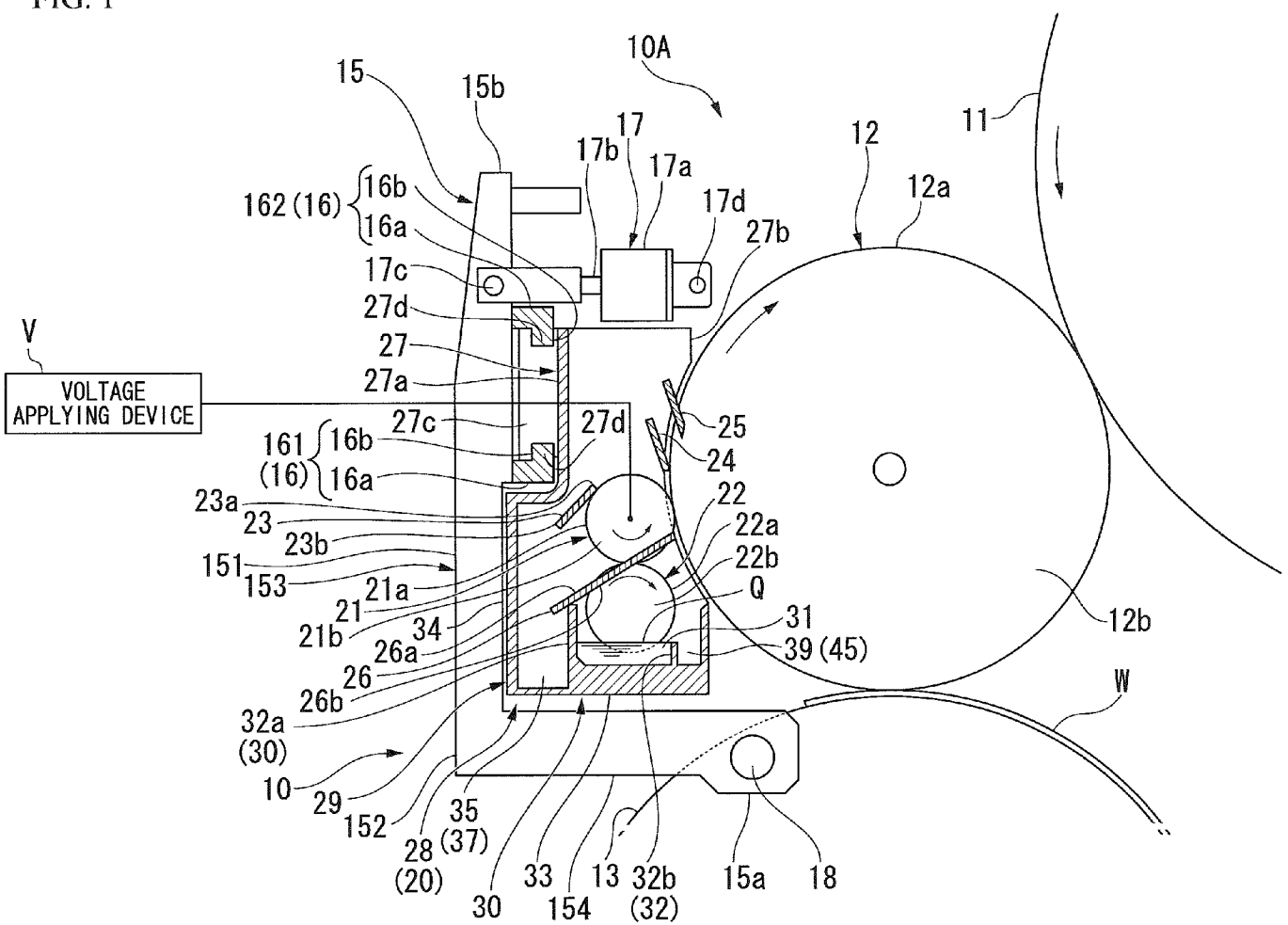
FIG. 1 is a schematic view that describes the principle of a transfer roller cleaning apparatus and a transfer photograph printer of a first embodiment related to the present invention.
Figure 3:
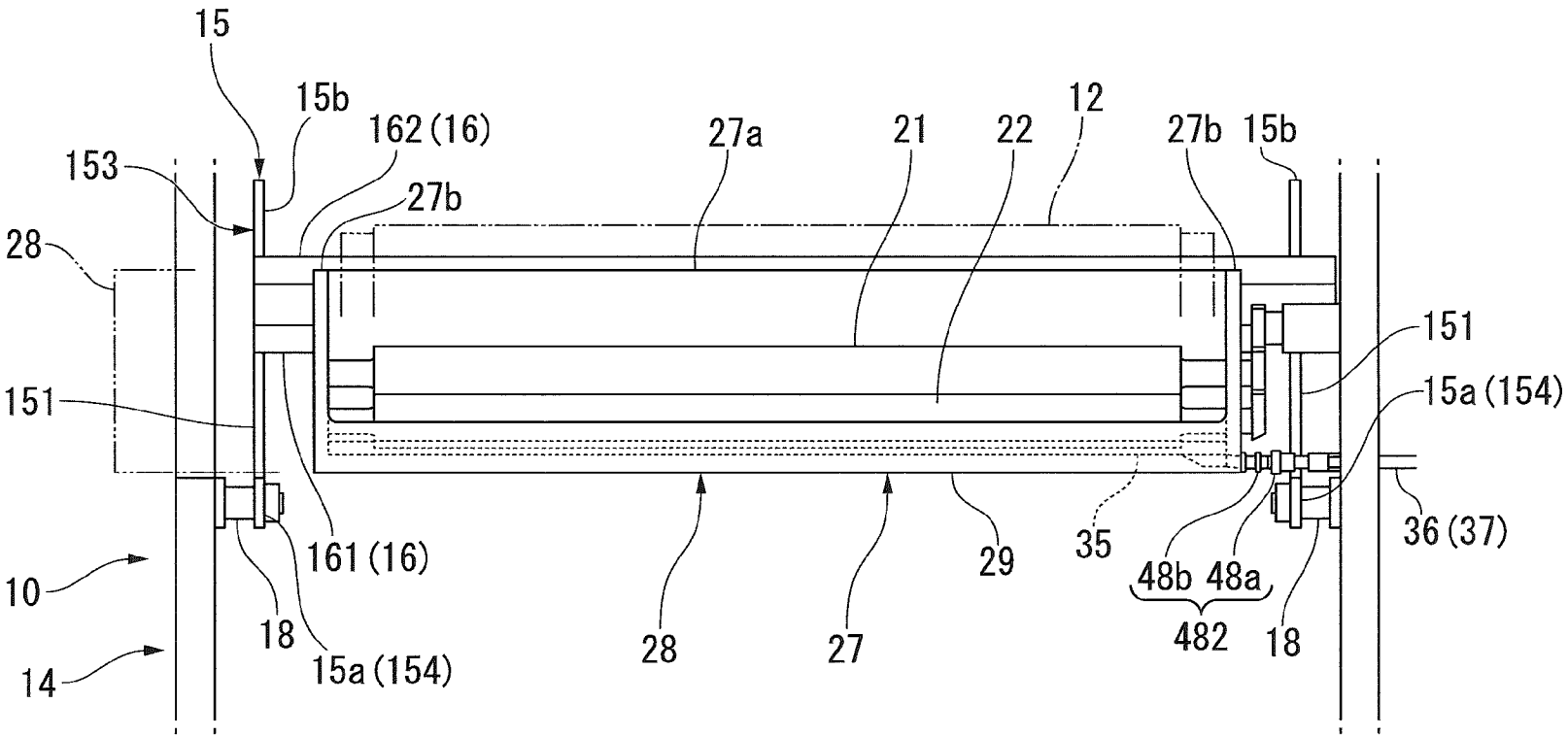
FIG. 3 is a diagram that illustrates a configuration in which a cassette and a cassette support frame of the transfer roller cleaning apparatus of FIG. 1 from a body side of the electronic photograph printer.

In FIGS. 1 and 3, an upper side is described as a top, and a lower side is described as a bottom.

FIG. 1 is an explanatory diagram that schematically illustrates the vicinity of a transfer roller cleaning apparatus 20 (hereinafter, simply referred to as a cleaning apparatus) of an electronic photograph printer 10 of the first embodiment of the present invention. An element 11 is a photosensitive drum, an element 12 is a transfer roller that is rotated adjacent to the photosensitive drum 11, and an element 13 is a backup roller that presses a recording target medium W such as paper to the transfer roller 12.

In the electronic photograph printer 10, the photosensitive drum 11 is rotated in an arrow direction at a fixed speed when forming images using driving means such as a motor (not illustrated). On a surface (a peripheral surface) of the photosensitive drum 11, a charging region is formed in which an entire width direction thereof along a central axis of the surface of the photosensitive drum 11 is equally charged using a charger (not illustrated). An electrostatic latent image is formed by partially removing the electric charge of the charging region through the exposure using an exposure device (not illustrated). On the surface of the photosensitive drum 11, a toner image is formed which forms the electrostatic latent image as a visible image by the supply of the developer using the liquid toner from a developer supply device.

The transfer roller 12 transfers the toner imager from the surface of the photosensitive drum 11 onto the recording target medium W by contacting photosensitive drum 11 and by being rotated The toner image formed on the surface of the photosensitive drum 11 is transferred onto the surface of the transfer roller 12 by a bias voltage applied via the transfer roller 12 and a nip pressure between the photosensitive drum 11 and the transfer roller 12. Next, the toner image is transferred onto the recording target medium W passing between the transfer roller 12 and the backup roller 13 from the transfer roller 12. A peripheral surface 12*a* of the transfer roller 12 is formed by a covering layer formed of a conductive gummy material provided on the outer periphery of the transfer roller 12.

In addition, in the present specification, a term "peripheral surface" regarding the roller indicates a cylindrical surface of an overall roller outer surface around a rotational axis (a central axis) of the roller. Furthermore, in the present specification, an expression "surface" regarding the roller indicates the peripheral surface.

In the present embodiment, the recording target medium W is paper such as a sheet of paper or long band-like continuous paper. However, the recording target paper W may be a sheet of film, for example, formed of a resin film a long band-like continuous film or the like, without being limited thereto. The material of the recording target medium W is not limited to a material such as a paper or a resin film. The shape of the recording target medium W may be that of a sheet of film-like member or a long band-shaped film-like member.

The cleaning apparatus 20 has a cleaning roller 21 that is rotated in the forward direction with the rotation of the transfer roller 12 adjacent to the surface (the peripheral surface 12*a*) of the transfer roller 12. The surface (the peripheral surface 21*a*) of the cleaning roller 21 contacts the downstream side in the rotation direction of the transfer roller 12, which is more downstream than the closest position in the peripheral surface 12*a* of the transfer roller relative to the backup roller 13. The surface (the peripheral surface 21*a*) of the cleaning roller 21 contacts the upstream side in the rotation direction of the transfer roller 12, which is more upstream than the contact portion of the transfer roller peripheral surface 12*a* with the photosensitive drum 11.

The cleaning apparatus 20 includes a carrier liquid vessel 30, a supply roller 22 that is immersed in the carrier liquid Q in the carrier liquid vessel 30, and a cleaning roller 21.

The surface (the peripheral surface 22*a*) of the supply roller 22 contacts the downstream side of the surface of the cleaning roller 21, which is more downstream than the contact portion of the cleaning roller 21 with the transfer roller 12 in the rotation direction. The supply roller 22 is rotated in the forward direction with respect to the cleaning roller 21. The supply roller 22 has a function of supplying the carrier liquid Q in the liquid vessel 30 to the cleaning roller 21.

The cleaning apparatus 20 has a cassette 28 of a schematic configuration in which the carrier liquid vessel 30, the supply roller 22 and the cleaning roller 21 are provided in the cassette frame 27.

The electronic photograph printer 10 has a body 10A of a configuration in which the photosensitive drum 11, the transfer roller 12, the backup roller 13, the charger, the exposure device, and the developer supply device are attached to the body frame 14. The cassette 28 is attached to the body 10A of the electronic photograph printer 10 in an attachable and detachable manner.

Figure 2:
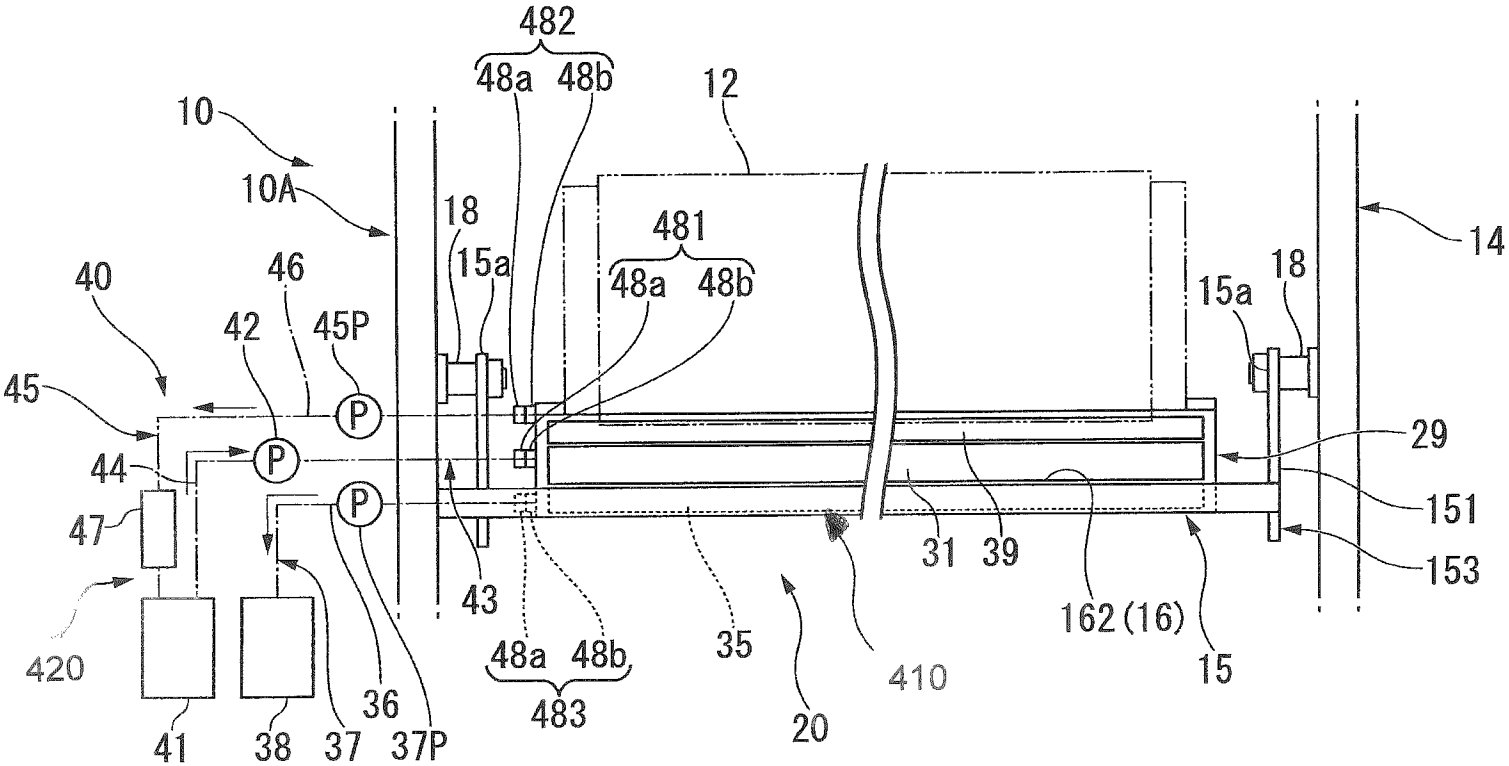
FIG. 2 is a plan view that schematically illustrates a configuration of a carrier liquid circulation device and a drainage path of the transfer roller cleaning apparatus of FIG. 1.

Solid lines in FIGS. 1, 2 and 3 indicate a state where the cassette 28 is attached to the body 10A of the electronic photograph printer 10.

The cleaning roller 21 and the supply roller 22 are rotated around the rotation axis that is parallel to the rotation axis of the transfer roller 12 along the horizontal direction.

The rotation axis of the supply roller 22 is provided in the extension direction of a carrier liquid storage groove 31 at the inside of the carrier liquid vessel 30 formed in a barrel shape. The supply roller 22 immerses the lower portion which is below the rotation axis in the carrier liquid Q in the carrier liquid storage groove 31. Thus, the cleaning apparatus 20 is able to supply the carrier liquid Q in the carrier liquid vessel 30 from the cleaning roller 21 to the surface of the transfer roller 12 via the supply roller 22.

In the exemplified cleaning apparatus 20, the cleaning roller 21 is provided so that the peripheral surface 21*a* thereof comes into contact with the upper portion than the center axis of the peripheral surface of the supply roller 22.

In the exemplified cleaning apparatus 20, an outer diameter (a diameter of the peripheral surface) of the cleaning roller 21 is identical to an outer diameter (the diameter of the peripheral surface) of the supply roller 22. The outer diameter of the cleaning roller 21 is smaller than the outer diameter of the transfer roller 12. However, the outer diameter of the cleaning roller 21 may not be necessarily identical to the outer diameter of the supply roller 22, but may be different from the outer diameter of the supply roller 22.

The cleaning apparatus 20 is configured so that the supply roller 22 is rotated at a peripheral speed (the rotation speed of the peripheral surface) that is lower (slower) than the cleaning roller 21, and the cleaning roller 21 is rotated at a peripheral speed (the rotation speed of the peripheral surface) that is lower (slower) than the transfer roller 12. Thus, the cleaning apparatus 20 is configured so that the supply roller 22 is rubbed and rotated on the cleaning roller 21 in the forward direction, and the cleaning roller 21 is rubbed and rotated on the transfer roller 12 in the forward direction. The cleaning roller 21 is rubbed and rotated on the supply roller 22 and the transfer roller 12 and supplies the carrier liquid Q received from the supply roller 22 to the surface of the transfer roller 12.

In the cleaning apparatus 20 illustrated in FIG. 1, the peripheral speed of the cleaning roller 21 is set to be 25 to 40 when the peripheral speed of the transfer roller 12 is 100. Furthermore, the peripheral speed of the supply roller 22 is set to be 60 to 80 when the peripheral speed of the cleaning roller 21 is 100.

However, the peripheral speeds of the supply roller 22 and the cleaning roller 21 may be suitably changed in a range in which the supply roller 22 is rubbed and rotated on the cleaning roller 21 at a peripheral speed that is lower (slower) than the cleaning roller 21, and the cleaning roller 21 is rubbed and rotated on the transfer roller 12 at a peripheral speed that is lower (slower) than the transfer roller 12.

The cleaning apparatus 20 can remove (recover) the residual toner on the surface of the transfer roller 12 so as to strip the residual toner off together with the carrier liquid from the transfer roller 12 to the cleaning roller 21, by the sliding-frictional rotation of the cleaning roller 21 to the transfer roller 12 at a peripheral speed that is lower (slower) than the transfer roller 12.

The residual toner of the peripheral surface 12*a* of the transfer roller is softened and dissolved by the carrier liquid that is supplied from the cleaning roller 21 to the peripheral surface of the transfer roller 12. The cleaning apparatus 20 removes the residual toner, which is softened and dissolved by the carrier liquid supplied from the cleaning roller 21 to the peripheral surface of the transfer roller 12, from the transfer roller 12 to the cleaning roller 21 by a difference in peripheral speed between the cleaning roller 21 and the transfer roller 12. Moreover, the cleaning apparatus 20 recovers the residual toner.

The bias voltage of the opposite polarity to the residual toner of the surface of the transfer roller 12 is applied to the cleaning roller 21. A reference numeral V in FIG. 1 is a voltage application device for applying the bias voltage to the cleaning roller 21. The cleaning apparatus 20 is able to reliably adsorb and recover the residual toner from the surface of the transfer roller 12 to the cleaning roller 21, by electrophoresing the residual toner of the surface of the transfer roller 12.

The voltage application device V is not mounted on the cassette 28 of the cleaning apparatus 20 of the illustrated example. The voltage application device V is placed outside the cassette 28. However, the voltage application device V may be mounted on the cassette.

The peripheral surface 21*a* of the cleaning roller 21 is formed by a gold roller (a metal roller formed of a conductive metal).

Bearing components of the supply roller 22 are formed by the electric insulation materials. However, the forming material of the outer peripheral portion of the supply roller 22 is not particularly limited. The toner and the carrier liquid, which are recovered from the peripheral surface of the transfer roller 12 to the peripheral surface of the cleaning roller 21, are removed from the cleaning roller peripheral surface 21*a* by a drainage recovery doctor blade 23 described later. Thereby, the toner and the carrier liquid are prevented from being moved from the surface of the cleaning roller 21 to the peripheral surface 22*a* of the supply roller 22.

As illustrated in FIG. 1, the cleaning apparatus 20 of the present embodiment includes a blade-shaped drainage recovery doctor blade 23 that is provided to contact with the surface of the cleaning roller 21 and removes the toner and the carrier liquid, which are recovered from the surface of the transfer roller 12 to the surface of the cleaning roller 21, from the surface of the cleaning roller 21. The drainage recovery doctor blade 23 is placed so that a leading end 23*a* thereof comes into contact with the cleaning roller 21 at the downstream side in the rotation direction further than the contact portion between the surface (the peripheral surface 21*a*) of the cleaning roller 21 and the transfer roller 12, and at the upstream side further than the contact portion between the surface (the peripheral surface 21*a*) of the cleaning roller 21 and the supply roller 22. Moreover, the drainage recovery doctor blade 23 scrapes out and removes the toner and the carrier liquid from the peripheral surface of the cleaning roller 21 by the leading end thereof that comes into contact with the peripheral surface of the cleaning roller 21.

The drainage recovery doctor blade 23 is obliquely provided so that a back end 23*b* opposite to a leading end 23*a* coming into contact with the surface of the cleaning roller 21 is located at a lower part than the leading end 23*a*. The cleaning apparatus 20 of the illustrated example is configured so that the toner and the carrier liquid recovered from the surface (the peripheral surface) of the cleaning roller 21 to the drainage recovery doctor blade 23 are introduced from the back end 23*b* of the drainage recovery doctor blade 23 to a recovery liquid discharging path 35 (a drainage discharging groove) formed in a groove shape in a member (a flow path groove forming member 29 described later) formed in the lower part thereof. The toner and the carrier liquid introduced from the drainage recovery doctor blade 23 to the recovery liquid discharging path 35 are lead to a drainage tank 38 provided outside the electronic photograph printer 10 via a drainage piping 36 illustrated in FIG. 2. The recovery liquid discharging path 35 (the recovery liquid discharging groove) and the drainage piping 36 are configured to serve as a drainage path 37 for introducing the toner and the carrier liquid recovered from the cleaning roller 21 by the drainage recovery doctor blade 23 to the drainage tank 38. The recovery liquid discharging path 35 (the recovery liquid discharging groove) and the drainage piping 36 are each a part of the drainage path 37.

The carrier liquid vessel 30 of the cleaning apparatus 20 illustrated in FIG. 1 is a part of the flow path groove forming member 29 formed with the recovery liquid discharging path 35.

As illustrated in FIGS. 1 and 3, the carrier liquid vessel 30 is constituted by a bottom wall portion 33 that is a portion located below the carrier liquid storage groove 31 in the flow path groove forming member 29, and a wall portion that surrounds the periphery of the carrier liquid storage groove 31 and is formed in a square frame shape at an upper side thereof. The square frame-shaped wall portion surrounding the periphery of the carrier liquid storage groove 31 is constituted by side wall portions 32 that are located at both sides in the width direction thereof via the carrier liquid storage groove 31, and end wall portions of both sides of the carrier liquid storage groove 31 in the extension direction.

The recovery liquid discharging path 35 is formed in a groove shape extended along the carrier liquid storage groove 31 in the flow path groove forming member 29 formed with the carrier liquid storage groove 31. The recovery liquid discharging path 35 is separated from the carrier liquid storage groove 31 by the other (denoted by reference numeral 32*a* in FIG. 1, hereinafter, referred to as a first side wall portion) of the side wall portions 32 of both sides via the carrier liquid storage groove 31. The first side wall portion 32*a* of the carrier liquid vessel 30 functions as a partition wall that divides the carrier liquid storage groove 31 from the recovery liquid discharging path 35.

The recovery liquid discharging path 35 is also surrounded by a square frame-shaped wall portion that is a portion of the flow path groove forming members 29 placed at both sides in the width direction thereof and at both sides in the extension direction. This is also true for the carrier liquid vessel 30 and the carrier liquid storage groove 31. Furthermore, this is also true for an overflow liquid storing groove 39 described later.

The flow path groove forming member 29 is formed in a linear shape that is extended along the extension direction (a longitudinal direction of FIGS. 2 and 3) of the carrier liquid storage groove 31 of the carrier liquid vessel 30. The carrier liquid storage groove 31, the recovery liquid discharging path 35, and the overflow liquid storing groove 39 described later are each formed to be extended along the lengthwise direction of the flow path groove forming member 29.

As illustrated in FIG. 1, the cleaning apparatus 20 of the illustrated example is configured so that the toner and the carrier liquid recovered from the surface of the cleaning roller 21 by the drainage recovery doctor blade 23 drop and are introduced from the drainage recovery doctor blade back end 23*b* placed above into the recovery liquid discharging path 35. However, the cleaning apparatus 20 is not limited to the configuration mentioned above, and may be configured to provide a flow path portion for causing the carrier liquid including the toner to flow down from the drainage recovery doctor blade back end 23*b* into the recovery liquid discharging path 35 and introducing the carrier liquid including the toner.

In the electronic photograph printer 10 of the illustrated example, the cleaning apparatus 20 includes a recovery liquid discharging path 35 and a drainage piping 36.

In the middle of the drainage piping 36 of the cleaning apparatus 20 of the illustrated example, a pump 37P for sending the toner and the carrier liquid introduced from the drainage recovery doctor blade 23 into the recovery liquid discharging path 35 to the drainage tank 38. The cleaning apparatus 20 of the illustrated example also includes the pump 37P.

The pump 37P in the middle of the drainage piping 36 is provided if necessary. It is also possible to adopt, as the drainage path 37, a configuration in which the toner and the carrier liquid introduced, for example, from the drainage recovery doctor blade 23 to the recovery liquid discharging path 35 smoothly flow down and are drained from the recovery liquid discharging path 35 to the drainage tank 38 placed below the recovery liquid discharging path 35 via the drainage piping 36. In this case, it is also possible to use, as the drainage path, a configuration in which the pump 37P in the middle of the drainage piping 36 is omitted.

As illustrated in FIG. 1, the cleaning apparatus 20 includes a cleaning doctor blade 24 that is provided so as to contact with the peripheral surface 12*a* of the transfer roller 12, and a transfer roller side doctor blade 25 that is provided adjacent to the end surface 12*b* of the transfer roller 12 in the axial direction. The transfer roller side doctor blades 25 are provided at both sides of the transfer roller 12 in the axial direction so as to correspond to the end surfaces 12*b* of both sides of the transfer roller 12 in the axial direction. Furthermore, the cleaning apparatus 20 of the illustrated example also has device side doctor blades 26 (side doctor blades) that are provided adjacent to the end surfaces 22*b* of both sides of the supply roller 22 in the axial direction and the end surfaces 21*b* of both sides of a cleaning roller 21 in the axial direction.

The cleaning doctor blade 24 is a blade-like member, a leading end of which comes into contact with the position of the downstream side further than the contact portion between the peripheral surface of the transfer roller 12 and the cleaning roller 21 in the rotation direction, and the position of the upstream side further than the contact portion between the peripheral surface of the transfer roller 12 and the photosensitive drum 11. The cleaning doctor blade 24 recovers and removes the residual toner and the carrier liquid from the peripheral surface of the transfer roller 12.

The cleaning apparatus 20 of the illustrated example is able to remove the residual toner and the carrier liquid from the transfer roller 12 by the cleaning doctor blade 24 when the toner and the carrier liquid not removed by the cleaning roller 21 remains on the surface (the peripheral surface) of the transfer roller 12.

The leading end of the cleaning doctor blade 24 coming into contact with the peripheral surface of the transfer roller 12 is located on the cleaning roller 21. Specifically, the leading end of the cleaning doctor blade 24 is placed above the portion of the downstream side of the contact portion between the peripheral surface of the cleaning roller 21 and the transfer roller 12 in the rotation direction, and the portion of the upstream side of the contact portion between the peripheral surface of the cleaning roller 21 and the leading end of the drainage recovery doctor blade 23. The cleaning doctor blade 24 causes the toner and the carrier liquid scraped and removed from the peripheral surface of the transfer roller 12 by the leading end coming into contact with the peripheral surface 12*a* of the transfer roller to drop down from the leading end to the cleaning roller 21. The toner and the carrier liquid removed from the peripheral surface of the transfer roller 12 by the cleaning doctor blade 24 are recovered from the peripheral surface of the cleaning roller 21 to the recovery liquid discharging path 35 by the drainage recovery doctor blade 23.

The transfer roller side doctor blade 25 removes the toner and the carrier liquid attached to the end surface 12*b* from the end surfaces 12*b* of both surfaces of the transfer roller 12 in the axial direction.

In the cleaning apparatus 20 illustrated in FIG. 1, the transfer roller side doctor blade 25 is provided to come into contact with the end surfaces 12*b* of both sides of the transfer roller 12 in the axial direction at the position of the downstream side further than the contact portion between the transfer roller 12 and the cleaning roller 21 in the rotation direction, and at the position of the upstream side further than the contact portion between the transfer roller 12 and the photosensitive drum 11. Furthermore, the transfer roller side doctor blade 25 is provided to come into contact with the outer peripheral portion of the transfer roller end surfaces 12*b*.

The transfer roller side doctor blade 25 scrapes out and removes the toner and the carrier liquid that are attached to the transfer roller end surfaces 12*b* from the end surfaces 12*b*. The toner and the carrier liquid removed from the transfer roller end surfaces 12*b* by the transfer roller side doctor blade 25 flow down and are introduced to the recovery liquid discharging path 35 via a flow path member (not illustrated).

The cleaning apparatus may have a configuration that causes the toner and the carrier liquid removed from the transfer roller end surfaces 12*b* by the transfer roller side doctor blade 25 to flow down to the portion located at the downstream side of the contact portion between the peripheral surface of the cleaning roller 21 and the transfer roller 12 in the rotation direction via the flow path member, and the portion located at the upstream side further than the contact portion between the peripheral surface of the cleaning roller 21 and the leading end of the drainage recovery doctor blade 23.

As illustrated in FIG. 1, the device side doctor blade 26 is provided throughout the end surface 22*b* (hereinafter, simply referred to as a supply roller end surface) of the supply roller 22 in the axial direction, and the end surface 21*b* (hereinafter, simply referred to as a cleaning roller end surface) of the cleaning roller 21 in the axial direction. The device side doctor blade 26 is a blade-like or a rod-like member, and the back end side portion coming into contact with the supply roller end surface 22*b* is obliquely provided so as to be located below the leading end side portion coming into contact with the end surface 21*b* of the cleaning roller 21 of the upper side of the supply roller 22.

The device side doctor blade 26 scrapes out and removes the carrier liquid attached to the supply roller end surface 22*b* and the cleaning roller end surface 21*b* and the cleaning roller end surface 21*b* from the roller end surfaces 21*b* and 22*a*.

The back end of the device side doctor blade 26 is located above the recovery liquid discharging path 35.

The carrier liquid removed from the supply roller end surface 22*b* and the cleaning roller end surface 21*b* by the side doctor blade 26 falls on the recovery liquid discharging path 35 located at the lower part from the back end of the device side doctor blade 26.

The drainage recovery doctor blade 23 is located above the device side doctor blade 26.

The device side doctor blade 26 prevents the carrier liquid (the carrier liquid including the toner) moved from the peripheral surface 21*a* of the cleaning roller 21 to the end surface 21*b* from flowing down in the carrier liquid vessel 30 via the supply roller end surface 22*b* and being mixed, from the contact portion between the cleaning roller 21 and the transfer roller 12 to the drainage recovery doctor blade 23.

The device side doctor blade 26 is placed so that the upper surface 26*a* of the portion brought into contact with the cleaning roller end surface 21*b* is located above the contact portion between the cleaning roller 21 and the supply roller 22. Approximately the whole portion of the device side doctor blade 26 brought into contact with the supply roller end surface 22*b* is located at the upstream side of the supply roller 22 in the rotation direction further than the contact portion between the supply roller 22 and the cleaning roller 21, and above the liquid surface of the carrier liquid Q in the carrier liquid storage groove 31 of the carrier liquid vessel 30.

The device side doctor blade 26 brings the lower surface 26*b* thereof into contact with the upper end portion of the first side wall portion 32*a* of the recovery liquid discharging path 35 side of the side wall portions 32 of both sides via the carrier liquid storage groove 31 of the carrier liquid vessel 30.

The carrier liquid (the carrier liquid not including the toner) attached to the supply roller end surface 22*b* in the carrier liquid storage groove 31 of the carrier liquid vessel 30 is scraped from the supply roller end surface 22*b* by the device side doctor blade 26, flows down along the lower surface 26*b* of the device side doctor blade is moved from the lower surface 26*b* of the device side doctor blade to the surface (the inner surface) of the carrier liquid storage groove 31 side of the first side wall portion 32*a* of the carrier liquid vessel 30, and returns to the carrier liquid storage groove 31.

According to the cleaning apparatus 20, it is possible to recover the carrier liquid attached to the supply roller end surface 22*b* in the carrier liquid storage groove 31 of the carrier liquid vessel 30 to the carrier liquid storage groove 31 of the inner side of the carrier liquid vessel 30 using the device side doctor blade 26. For this reason, the cleaning apparatus 20 is able to prevent the carrier liquid attached to the supply roller end surface 22*b* from being scattered from the supply roller 22 due to the rotation of the supply roller 22 and being wastefully consumed.

In the flow path groove forming member 29 of the cleaning apparatus 20 illustrated in FIG. 1, the carrier liquid storage groove 31 and the recovery liquid discharging path 35 (the recovery liquid discharging groove) extended along the carrier liquid storage groove 31 are formed in a depressed groove shape from the upper surface thereof.

An overflow liquid storing groove 39 extended along the carrier liquid storage groove 31 is formed at a side of the flow path groove forming member 29 opposite to the recovery liquid discharging path 35 via the carrier liquid storage groove 31.

As illustrated in FIG. 2, the cleaning apparatus 20 of the present embodiment includes a storage tank 41 that is placed outside the body 10A and outside the cassette 28 to store the carrier liquid, and a carrier liquid sending path 43 that sends the carrier liquid in the storage tank 41 to the carrier liquid storage groove 31 in the carrier liquid vessel 30 using the pump 42. The carrier liquid sending path 43 has a configuration that has a supply piping 44 that leads the carrier liquid in the storage tank 41 into the carrier liquid storage groove 31 of the carrier liquid vessel 30, and has the pump 42 provided in the middle of the supply piping 44.

The cleaning apparatus 20 includes an overflow liquid recovery path 45 that returns the carrier liquid overflowed from the carrier liquid storage groove 31 of the carrier liquid vessel 30 to the storage tank 41. The overflow liquid recovery path 45 includes an overflow liquid storing groove 39 that is formed in the flow path groove forming member 29.

The carrier liquid in the storage tank 41 is always supplied to the carrier liquid storage groove 31 of the inside of the carrier liquid vessel 30 via the carrier liquid sending path 43. The flow rate of the carrier liquid sent from the carrier liquid sending path 43 to the carrier liquid storage groove 31 is set to an amount that exceeds a supply amount (a consumption amount) of the carrier liquid from the cleaning roller 21 to the transfer roller 12 accompanied by the rotation of the supply roller 22 and the cleaning roller 21 when operating the electronic photograph printer 10. That is, the cleaning apparatus 20 sets the sending amount of the carrier liquid that is sent (supplied) from the storage tank 41 to the carrier liquid storage groove 31 via the carrier liquid sending path 43 so that the overflow of the carrier liquid from the carrier liquid storage groove 31 is always continued.

As illustrated in FIG. 1, in the side wall portions 32 of both sides of the carrier liquid vessel 30, the side wall portion 32*b* (hereinafter, also referred to as a second side wall portion) of a side opposite to the first side wall portion 32*a* is configured so that an upward projection dimension from the bottom wall portion 33 of the carrier liquid vessel is smaller (lower) than that of the first side wall portion 32*a*. Moreover, the flow path groove forming member 29 and the carrier liquid vessel 30 are configured so that the overall carrier liquid overflowed from the carrier liquid storage groove 31 flows in the overflow liquid storing groove 39. The total amount of the carrier liquid overflowed from the carrier liquid vessel 30 flows over the second side wall portion 32*b* and flows in the overflow liquid storing groove 39.

The overflow liquid storing groove 39 serves as an overflow liquid storing portion in which the carrier liquid overflowed from the carrier liquid vessel 30 flows.

As illustrated in FIG. 2, the overflow liquid recovery path 45 has the overflow liquid storing groove 39, a recovery piping 46 that leads the carrier liquid in the overflow liquid storing groove 39 into the storage tank 41, a pump 45P that is interposed in the middle of the recovery piping 46, and a filter 47.

The carrier liquid flowed in the recovery piping 46 from the overflow liquid storing groove 39 is delivered to the storage tank 41 by the pump 45P.

The filter 47 removes contaminants (foreign matter) such as the metal abrasion powders from the carrier liquid flowing through the recovery piping 46, and maintains the cleanness of the carrier liquid.

The cleaning apparatus 20 may have a configuration in which the filter 47 is provided not in the overflow liquid recovery path 45 but in the carrier liquid sending path 43. However, the filter 47 is preferably provided in the overflow liquid recovery path 45 from an advantage of avoiding the emergence mixture of contaminants (foreign matter) such as the metal abrasion powders to the carrier liquid in the storage tank 41. Furthermore, the cleaning apparatus 20 may have a configuration in which the filters 47 are provided at both sides of the overflow liquid recovery path 45 and the carrier liquid sending path 43.

The cleaning apparatus 20 has a carrier liquid circulation device 40 that consists of the carrier liquid storage groove 31 of the inside the carrier liquid vessel 30, the storage tank 41, the carrier liquid sending path 43, and the overflow liquid recovery path 45. The carrier liquid circulation device 40 constitutes a carrier liquid circulation path that returns the carrier liquid, which is supplied from the storage tank 41 to the carrier liquid storage groove 31 via the carrier liquid sending path 43 and is overflowed, to the storage tank 41 via the overflow liquid recovery path 45.

According to such a configuration, the carrier liquid in the carrier liquid vessel 30 is always changed by the circulation, and thus it is possible to stably maintain characteristics of the carrier liquid in the carrier liquid vessel 30. Furthermore, the cleaning apparatus 20 is able to uniformly maintain the density of the carrier liquid in the carrier liquid vessel 30, without separately providing a mechanism that promotes stirring of the carrier liquid. Thereby, the cleaning apparatus 20 effectively contributes stability of the print quality of the electronic photograph printer 10 provided with the cleaning apparatus 20.

The storage tank 41 is able to separately inject the carrier liquid from the outside to the inside of the storage tank 41 in addition to the inflow of the carrier liquid from the overflow liquid recovery path 45.

As illustrated in FIGS. 1 and 3, the flow path groove forming member 29 forms a part of the cassette frame 27 of the cassette 28. The cassette frame 27 has, the flow path groove forming member 29, a back board portion 27*a* that also serves as a wall portion (a discharging path side wall portion 34) of a side opposite to the first side wall portion 32*a* of the carrier liquid vessel 30 via the recovery liquid discharging path 35 of the flow path groove forming member 29, and roller support plates 27*b* that are projected from both end portions of the flow path groove forming member 29 in the lengthwise direction. The back board portion 27*a* and the roller support plates 27*b* are projected at the upper surface side of the flow path groove forming member 29 to which the carrier liquid storage groove 31, the recovery liquid discharging path 35, and the overflow liquid storing groove 39 are opened so as to start from the flow path groove forming member 29.

The roller support plates 27*b* of both sides of the cassette frame 27 are formed vertically in the lengthwise direction of the flow path groove forming member 29. The cassette 28 has the supply roller 22 and the cleaning roller 21 attached to the cassette frame 27. The supply roller 22 and the cleaning roller 21 each rotatably attach the both end portions of the rotation axis to the roller support plates 27*b* of the cassette frame 27, and are installed between a pair of roller support plates 27*b* of the cassette frame 27 in a built state. Furthermore, the cassette 28 also has the drainage recovery doctor blade 23, the cleaning doctor blade 24, the transfer roller side doctor blade 25, and the device side doctor blade 26 that are fixed and attached to the cassette frame 27 of the cassette 28.

The back board portion 27*a* is a plate-like portion that has a projection dimension from the groove bottom of the recovery liquid discharging path 35 is greater than that of the first side wall portion 32*a*. In the back board portion 27*a*, a portion facing the first side wall portion 32*a* via the recovery liquid discharging path 35 functions as the discharging path side wall portion 34.

The cassette frame 27 has a rail engagement projection portion 27*c* that is projected to the back opposite to the front side on which the carrier liquid vessel 30 of the back board portion 27*a* provided integrally in the back board portion 27*a* is placed.

The electronic photograph printer 10 has a cassette support lever 15 that is rotatably attached to the body frame 14. The cassette support lever 15 serves as a fixture for attaching the cassette 28 to the body 10A of the electronic photograph printer 10 in an attachable and detachable manner. A rail 16 for guiding the cassette 28 and slide-moving the cassette 28 with respect to the cassette support lever 15 and the transfer roller 12 of the body 10A of the electronic photograph printer 10 along the center axis (the rotation axis) of the transfer roller 12 is attached to the cassette support lever 15. The rail 16 is attached to the cassette support lever 15 in a direction that is extended along the center axis of the transfer roller 12.

The cassette 28 of an attached state (a state illustrated in FIGS. 1 to 3) to the body 10A of the electronic photograph printer 10 is fixed to the cassette support lever 15 by a clamp device (not illustrated) provided in the cassette support lever 15. Furthermore, the cassette 28 of the attached state is placed so as to be interposed between the cassette support lever 15 and the transfer roller 12, and the cleaning roller 21 is pressed to the transfer roller 12 by a predetermined pressing force. At this time, in the cassette support lever 15, a portion (a leading end portion 15*b* located at an upper end portion in an illustrated example) of the upper side from the proximal end portion 15*a* fixed to the body frame 14 at a side lower than the transfer roller 12 by a horizontal rotation axis is supported so that a distance from the transfer roller 12 is not increased by a fluid pressure cylinder device 17 that connects the portion and the body frame 14. Thereby, a state is maintained where the cleaning roller 21 of the cassette 28 is pressed to the transfer roller 12 by a predetermined pressing force.

In FIG. 1, reference numeral 18 is a rotation support shaft. The proximal end portion 15*a* of the cassette support lever 15 is fixed to the body frame 14 by the horizontal rotation axis via the rotation support shaft 18.

Specifically, the cassette support lever 15 illustrated in FIGS. 1 to 3, has a structure in which one sides of both side portions from a curved portion 152 of a pair of curved rod members 151 formed in an L shape are connected to each other by two rails 16 parallel to each other, and the pair of curved rod members 151 are fixed to each other in parallel.

In the cassette support lever 15, hereinafter, a portion in which one sides of one side from the curved portion 152 of the pair of curved rod members 151 are connected to each other by the rail 16 is also referred to as a cassette attachment portion 153. Specifically, the proximal end portion 15*a* of the cassette support lever 15 is an end portion of a side opposite to the curved portion 152 of a portion (hereinafter, also referred to as a proximal end side support material portion 154) that is extended in a direction that is not the cassette attachment portion 153 via the curved portion 152 of the pair of curved rod members 151. Meanwhile, the leading end portion 15*b* of the cassette support lever 15 is an end portion of a side opposite to the curved portion 152 of the cassette attachment portion 153 that is extended perpendicularly to the proximal end side support material portion 154 from the curved portion 152 of the curved rod member 151.

In the attached state illustrated in FIG. 1, the cassette support lever 15 is configured so that the proximal end side support material portion 154 of the curved rod member 151 is placed in a direction along a horizontal surface, and the cassette attachment portion 153 is placed in a direction perpendicular to the proximal end side support material portion 154.

The fluid pressure cylinder device 17 is configured so that one side (a leading end portion of a piston 17*b* projected from the cylinder main body 17*a* in FIG. 1) of both end portions in an expansion and contraction direction thereof is attached to the cassette support lever 15 via the rotation shaft 17*c* by the horizontal rotation axis in a freely rotatable manner, and the other (an end portion of a side opposite to the leading end portion of the piston 17*b* of the cylinder main body 17*a* in FIG. 1) of both end portions in the expansion and contraction direction is attached to the body frame 14 via the rotation shaft 17*d* by the horizontal rotation axis in a freely rotatable manner.

The fluid pressure cylinder device 17 is configured so that the projection dimension from the cylinder main body 17*a* of the piston 17*b* is sufficiently smaller than the projectable maximum dimension when keeping the attached state of the cassette 28 to the body frame 14 of the electronic photograph printer 10.

As illustrated in FIGS. 2 and 3, the carrier liquid circulation device 40 has a cassette side flow path portion 410 provided in the cassette 28, and an external flow path portion 420 located outside the cassette 28.

The carrier liquid storage groove 31 of the inside of the carrier liquid vessel 30 and the overflow liquid storing groove 39 of the overflow liquid recovery path 45 are a part of the cassette side flow path portion 410. Furthermore, the cassette side flow path portion 410 of the carrier liquid circulation device 40 of the illustrated example also includes a region (a flow path) between the carrier liquid storage groove 31 of the carrier liquid vessel 30 and the overflow liquid storing groove 39 in which the carrier liquid overflowed from the carrier liquid vessel 30 and flowed in the overflow liquid storing groove 39 flows.

As illustrated in FIG. 2, the supply piping 44 of the carrier liquid sending path 43 of the carrier liquid circulation device 40 communicates with and is connected to the carrier liquid storage groove 31 via a one-touch coupler 481 that is formed by fitting a socket 48*a* attached to the end portion of the carrier liquid vessel 30 side to the plug 48*b* attached to the flow path groove forming member 29 in an attachable and detachable manner.

The recovery piping 46 of the overflow liquid recovery path 45 communicates with and is connected to the overflow liquid storing groove 39 via a one-touch coupler 482 that is formed by fitting the socket 48*a* attached to the end portion of the flow path groove forming member 29 side to the plug 48*b* attached to the flow path groove forming member 29 in an attachable and detachable manner.

The plug 48*b* of the one-touch coupler of reference numeral 481 communicates with the carrier liquid storage groove 31 via the flow path formed in the flow path groove forming member 29, and the plug 48*b* of the one-touch coupler of reference numeral of 482 communicates with the overflow liquid storing groove 39 via the flow path formed in the flow path groove forming member 29.

The external flow path portion 420 of the carrier liquid circulation device 40 has a configuration that has the storage tank 41, the supply piping 44, the pump 42, the recovery piping 46, the pump 45P and the filter 47.

The carrier liquid circulation device 40 has a configuration in which the cassette side flow path portion 410 and the external flow path portion 420 are connected to each other by the one-touch couplers 481 and 482 in an attachable and detachable manner. Specifically, the supply piping 44 and the carrier liquid storage groove 31 can be connected to each other by the one touch coupler in an attachable and detachable manner, and the recovery piping 46 and the overflow liquid storing groove 39 are connected to each other by the one touch coupler in an attachable and detachable manner.

As illustrated in FIGS. 2 and 3, the drainage piping 36 of the drainage path 37 communicates with and is connected to the recovery liquid discharging path 35 (the recovery liquid discharging groove) through the one-touch coupler 483 that is formed by fitting the socket 48*a* attached to the end portion of the flow path groove forming member 29 side to the plug 48*b* attached to the flow path groove forming member 29 in an attachable and detachable manner.

The plug 48*b* of the one-touch coupler 483 communicates with the recovery liquid discharging path 35 (the recovery liquid discharging groove) via the flow path formed in the flow path groove forming member 29.

Since FIG. 3 is a diagram in which the cassette 28 and the cassette support lever 15 are viewed from the body 10A side of the electronic photograph printer 10, only the one-touch coupler 482 of the overflow liquid recovery path 45 among the one-touch couplers 481, 482 and 483 are illustrated. The one-touch coupler 481 of the carrier liquid sending path 43 and the one-touch coupler 483 of the drainage path 37 are located at the inside of a paper spacer further than the one-touch coupler 482 of the overflow liquid recovery path 45 in FIG. 3.

The cassette 28 is able to separate the cleaning roller 21 from the transfer roller 12 by stretching (increasing a projection dimension from the cylinder main body 17*a* of the piston 17*b*) the fluid pressure cylinder device 17 from a state illustrated in FIG. 1, rotating the cassette support lever 15 round the rotation support shaft 18 and increasing the distance from the transfer roller 12. Thereby, the attached state of the cassette 28 to the body 10A of the electronic photograph printer 10 is released, and enters the separated state from the body 10A.

In regard to the cassette support lever 15, a state of supporting the cassette 28 in an attached state to the body 10A of the electronic photograph printer 10 is also referred to as a closed state, and a state where the distance of the cassette support lever 15 from the transfer roller 12 is increased compared to the closed state, and a portion between the cassette 28 supported in the cassette support lever 15 and the transfer roller 12 is opened to a degree that a worker can put a hand and easily perform a work is also referred to as an open state.

The cassette 28 can be slide-moved in the extension direction of the rail 16 to the cassette support lever 15, by removing the plug 48*b* from the socket 48*a* of the one-touch couplers 481, 482 and 483, disconnects the connection of the drainage pipings 36, 44 and 46 to the flow path groove forming member 29 and releases the fixation of the cassette 28 to the cassette support lever 15 due to the clamp device.

The cassette 28 can be pulled out from the cassette support lever 15 as illustrated by an imaginary line in FIG. 3 by the movement along the rail 16.

The cassette 28 is able to effectively perform the maintenance or the like of the supply roller 22, the cleaning roller 21 and each member provided in the cassette 28 by being taken out from the electronic photograph printer 10.

As illustrated in FIG. 1, the cassette 28 engages the rail engagement projection portion 27*c* of the cassette frame 27 with the rail 16 of the cassette support lever 15 and is attached to the cassette support lever 15 so as to slide-movably in the extension direction of the rail 16.

In FIG. 1, the cassette 28 is each engaged with the pair of rails 16 provided so as to be separated from each other in a vertical direction of the cassette attachment portion 153 of the cassette support lever 15, and is attached to the cassette support lever 15 so as to be slide-movable in the extension direction of the rail 16. The pair of rails 16 of the cassette support lever 15 has a rail main body 16*a* that is fixed to the portion located in the cassette attachment portion 153 of the curved rod member 151 and is projected vertically in the lengthwise direction thereof. In the lower rail 16 (hereinafter, also referred to as a first rail 161), a rib-like locking projection portion 16*b*, which is projected from the projection leading end portion of the rail main body 16*a* toward the upper rail 16 (hereinafter, also referred to as a second rail 162), is formed throughout the entire length in the lengthwise direction thereof. In the upper second rail 162, a rib-like locking projection portion 16*b*, which is projected from the projection leading end portion of the rail main body 16*a* toward the first rail 161, is formed throughout the entire length in the lengthwise direction thereof.

The cassette 28 accommodates the rib-like locking projection portion 16*b* of the rail 16 in locking grooves 27*d* formed at both upper and lower sides of the rail engagement projection portion 27*c*, and is attached so as to be slidable and movable in the extension direction of the rail 16. The first rail 161 mainly bears the weight of the cassette 28.

According to such an attachment structure, falling-out of the rail engagement projection portion 27*c* from the rail 16 is restricted by the locking projection portion 16*b* of the rail 16 accommodated in the locking groove 27*d* of the rail engagement projection portion 27*c*, and thus there is no risk of careless falling of the cassette 28 from the cassette support lever 15.

The configuration, which accommodates the locking projection portion 16*b* of the pair of rails 16 provided vertically so as to be separated from each other in the locking grooves 27*d* formed on up and down both sides of the rail engagement projection portion 27*c*, effectively contributes stabilization of the attachment direction of the cassette 28 to the cassette support lever 15. The cassette 28 is able to easily enhance the accuracy and stability of the cassette 28 relative to the cassette support lever 15, by forming the locking grooves 27*d* of the rail engagement projection portion 27*c* to a size and a shape that can accommodate the locking projection portion 16*b* without generating a backlash as much as possible.

An improvement in accuracy of the attachment direction of the cassette 28 to the cassette support lever 15 has an advantage that can make a contact position of the cleaning roller 21 to the transfer roller 12 highly accurate, for example, when setting the cassette 28 outside the body of the electronic photograph printer 10 to an attached state to the body 10A of the electronic photograph printer 10. Furthermore, it is also possible to make the contact position of the cleaning doctor blade 24 and the transfer roller side doctor blade 25 to the transfer roller 12 highly accurate when attaching the cassette 28 to the body 10A of the electronic photograph printer 10.

An attachment structure, which engages the rail engagement projection portion 27*c* of the cassette frame 27 with the rail 16 of the cassette support lever 15 and attaches the cassette 28 to the cassette support lever 15 so as to be slidable and movable in the extension direction of the rail 16, is not limited to a configuration of an illustrated example.

For example, it is also possible to adopt a configuration in which a rail of a configuration that the rib-like locking projection portion 16*b* is projected only at the lower side or both upper and lower sides of the leading end portion of the rail main body 16*a* in FIG. 1, and the entire rail is accommodated in the groove formed in the rail engagement projection portion 27*c*. In the rail engagement projection portion 27*c*, a groove including the locking groove 27*d* for accommodating the rib-like locking projection portion 16*b* of the rail is formed.

In this case, even if the rail is only one, it is possible to support the cassette 28 with respect to the cassette support lever 15 in a relatively stable state.

In an embodiment related to the present invention, the cassette 28 may be attached to the cassette support lever 15 by one or three or more rails so as to be slidable and movable in the extension of the rail.

In order to attach the cassette 28 of the outside of the electronic photograph printer 10 to the body 10A of the electronic photograph printer 10, the cassette 28 engaged with the rail 16 of the cassette support lever 15 of the state of opening the rail engagement projection portion 27*c* is slidably moved in the extension direction along the rail 16. Moreover, the cassette 28 is placed at a predetermined position. The cassette 28 placed at a predetermined position is fixed to the cassette support lever 15 by the clamp device.

Next, the supply piping 44 of the carrier liquid circulation device 40 is connected to the carrier liquid storage groove 31, the recovery piping 46 is connected to the overflow liquid storing groove 39, and the drainage piping 36 is connected to the recovery liquid discharging path 35 (the recovery liquid discharging groove) using the one-touch couplers 481, 482 and 483 and forms the piping connection state illustrated in FIGS. 1 to 3.

Next, a projection dimension from the cylinder main body 17*a* of the piston 17*b* of the fluid pressure cylinder device 17 is reduced, and the cassette support lever 15 of the opened state enters the closed state. Thereby, the cleaning roller 21 of the cassette 28 comes into contact with the transfer roller 12, and there is provided a state where the cassette 28 is attached to the body 10A of the electronic photograph printer 10.

In the cleaning apparatus 20 of the present embodiment, the cleaning roller 21 supplied to the surface (the peripheral surface) of the transfer roller 12 removes the carrier liquid in the carrier liquid vessel 30 so as to strip off the residual toner of the peripheral surface of the transfer roller 12 by a difference in peripheral speed between the cleaning roller 21 and the transfer roller 12. In addition, the bias voltage of the opposite polarity to the residual toner of the surface of the transfer roller 12 is applied to the cleaning roller 21. Thereby, the residual toner from the peripheral surface of the transfer roller 12 is effectively recovered.

For this reason, according to the cleaning apparatus 20, it is possible to suppress the supply amount of the carrier liquid (in other words, the consumption amount of the carrier liquid) to the peripheral surface of the transfer roller 12 for dissolving the residual toner of the peripheral surface of the transfer roller 12 compared to Japanese Unexamined Patent Application, First Publication No. 2010-122252.

In the cleaning apparatus 20, the peripheral speed of the cleaning roller 21 is 25 to 40 when the peripheral speed of the transfer roller 12 is 100, and the peripheral speed of the supply roller 22 is 60 to 80 when the peripheral speed of the cleaning roller 21 is 100. It is possible to reduce the amount of the carrier liquid consumed due to this configuration.

According to the configuration, the carrier liquid supplied from the carrier liquid vessel 30 to the transfer roller 12 via the supply roller 22 and the cleaning roller 21 is thinned due to a difference in the peripheral speed between the rollers under a situation where a predetermined contact pressure is applied between the supply roller 22 and the cleaning roller 21. In addition, the thinned carrier liquid is further thinned due to a difference in the peripheral speed between the rollers under a situation where a predetermined contact pressure is applied between the cleaning roller 21 and the transfer roller 12, and is supplied from the cleaning roller 21 to the transfer roller 12.

As mentioned above, the cleaning apparatus 20 is able to suppress the amount of the carrier liquid supplied to the peripheral surface of the transfer roller 12 by the configuration in which the cleaning roller 21 removes the residual toner from the peripheral surface of the transfer roller 12 by a difference in the peripheral speed between the cleaning roller 21 and the transfer roller 12.

In order to realize the removal of the residual toner from the peripheral surface of the transfer roller 12 without irregularity, while suppressing the amount of carrier liquid supplied to the peripheral surface of the transfer roller 12 and narrow the amount of carrier liquid supplied to the peripheral surface of the transfer roller 12 to the minimum requirement, it is necessary to uniformly and stably maintain the supply of the carrier liquid to the peripheral surface of the transfer roller 12.

As mentioned above, a configuration, which thins the carrier liquid supplied to the transfer roller 12 from the inside of the carrier liquid vessel 30 via the supply roller 22 and the cleaning roller 21 by the difference in the peripheral speed between the rollers under a situation where a predetermined contact pressure is applied, is advantageous to uniformly maintain the supply of the carrier liquid to the peripheral surface of the transfer roller 12 on the peripheral surface of the transfer roller 12, and is able to easily realize regularization and stabilization of the supply of the carrier liquid to the peripheral surface of the transfer roller 12. As a result, the cleaning apparatus 20 is able to reduce the amount of carrier liquid supplied to the peripheral surface of the transfer roller 12 within a range capable of realizing the removal of the residual toner from the peripheral surface of the transfer roller 12 without irregularity, and as a result, it is possible to easily realize a reduction of the amount of carrier liquid consumed and a reduction in cost, while securing high print quality.

The cleaning apparatus 20 is able to reduce the volume of the carrier liquid vessel 30 by the reduction of the amount of carrier liquid consumed. As a result, the carrier liquid in the carrier liquid vessel 30 is always circulated and replaced by the carrier liquid circulation device 40, and thus it is also easy to stably maintain the characteristics of the carrier liquid in the carrier liquid vessel 30.

The cleaning apparatus 20 includes a configuration that performs the supply of the carrier liquid to a peripheral surface of the transfer roller and the recovery of the residual toner from the peripheral surface of the transfer roller 12 by the cleaning roller 21. For this reason, compared to the configuration that requires two devices (the carrier liquid supply device and the cleaning apparatus) as in the device (the electronic photograph printer) of the related art disclosed in Japanese Unexamined Patent Application, First Publication No. 2010-122252, the manufacturing cost of the device can be easily reduced, and it is possible to simplify various work such as the operation and maintenance of the device and the control. Furthermore, the cleaning apparatus 20 can be easily downsized compared to the device of the related art disclosed in Japanese Unexamined Patent Application, First Publication No. 2010-122252.

Although an exemplary example of the present invention has been described, the present invention is not limited to the exemplary example explained above, and various alterations can be made within a scope that does not depart from the gist of the present invention.

For example, although a configuration has been described in the embodiment mentioned above that adopts the flow path groove forming member 29 formed with the carrier liquid storage groove 31, the recovery liquid discharging path 35 (the recovery liquid discharging groove), and the overflow liquid storing groove 39, in the embodiment related to the present invention, it is also possible to adopt, for example, a configuration in which the carrier liquid storage groove 31, the recovery liquid discharging path 35 (the recovery liquid discharging groove), and the overflow liquid storing groove 39 are formed in members different from each other, without being limited thereto.

However, if adopting the flow path groove forming member 29, there is an advantage that the configuration can be downsized compared to the configuration in which the carrier liquid storage groove 31, the recovery liquid discharging path 35 (the recovery liquid discharging groove), and the overflow liquid storing groove 39 are formed in members different from each other.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A transfer roller cleaning apparatus that cleans a transfer roller of a wet type electronic photograph printer that uses developer consisting of a liquid toner and a carrier liquid, the apparatus comprising:

a supply roller that is immersed in the carrier liquid in a carrier liquid vessel;

a cleaning roller that is rubbed and rotated on the supply roller and the transfer roller, supplies the carrier liquid received from the supply roller to a surface of the transfer roller, and removes a residual toner from the surface of the transfer roller together with the carrier liquid; and a carrier liquid circulation device which includes the carrier liquid vessel, supplies the carrier liquid in a storage tank to the carrier liquid vessel using a pump, and sends the carrier liquid overflowed from the carrier liquid vessel back to the storage tank via an overflow liquid recovery path so as to constitute a carrier liquid circulation path; and a voltage application device which applies bias voltage to the cleaning roller, the bias voltage having opposite polarity to the residual toner on the surface of the transfer roller, wherein the cleaning roller is structured to be rubbed and rotated on the transfer roller in a forward direction thereof, and to be rotated at a peripheral speed which is lower than that of the transfer roller.

2. The transfer roller cleaning apparatus according to claim 1, further comprising:

a drainage recovery doctor blade that is placed at a downstream side of the cleaning roller in a rotation direction further than a contact portion between the cleaning roller and the transfer roller so that a leading end portion thereof comes into contact with the cleaning roller; and a drainage path that guides the recovery liquid recovered from the cleaning roller using the drainage recovery doctor blade to a drainage tank placed outside the electronic photograph printer via a recovery liquid discharging path that is provided independently from a carrier liquid storage groove of the inside of the carrier liquid vessel.

3. An electronic photograph printer comprising the transfer roller cleaning apparatus according to claim 2.

4. The transfer roller cleaning apparatus according to claim 2, further comprising:

a cassette that is configured by providing the supply roller, the cleaning roller, the carrier liquid vessel, and an overflow liquid storing portion that causes the carrier liquid overflowed from the carrier liquid vessel in the overflow liquid recovery path to flow in a cassette frame, and is attached to a body of the electronic photograph printer in an attachable and detachable manner, and wherein a cassette side flow path portion of the carrier liquid circulation device provided in the cassette and an external flow path portion located outside the cassette are connected to each other using a one-touch coupler in an attachable and detachable manner.

5. An electronic photograph printer comprising the transfer roller cleaning apparatus according to claim 4.

6. The transfer roller cleaning apparatus according to claim 2, wherein the pump of the carrier liquid circulation device and the storage tank are placed outside the electronic photograph printer, and a filter, which removes contaminants from the carrier liquid flowing through the carrier liquid circulation path, is provided at a location of the carrier liquid circulation device located outside the electronic photograph printer.

7. An electronic photograph printer comprising the transfer roller cleaning apparatus according to claim 6.

8. The transfer roller cleaning apparatus according to claim 2, further comprising:

a side doctor blade that is provided in contact with an end surface of the cleaning roller in an axial direction, recovers the carrier liquid attached to the end surface of the cleaning roller in the axial direction, and guides the carrier liquid into the recovery liquid discharging path.

9. The transfer roller cleaning apparatus according to claim 3, further comprising:

a cassette that is configured by providing the supply roller, the cleaning roller, the carrier liquid vessel, and an overflow liquid storing portion that causes the carrier liquid overflowed from the carrier liquid vessel in the overflow liquid recovery path to flow in a cassette frame, and is attached to a body of the electronic photograph printer in an attachable and detachable manner, and wherein a cassette side flow path portion of the carrier liquid circulation device provided in the cassette and an external flow path portion located outside the cassette are connected to each other using a one-touch coupler in an attachable and detachable manner.

10. An electronic photograph printer comprising the transfer roller cleaning apparatus according to claim 9.

11. The transfer roller cleaning apparatus according to claim 8, wherein the pump of the carrier liquid circulation device and the storage tank are placed outside the electronic photograph printer, and a filter, which removes contaminants from the carrier liquid flowing through the carrier liquid circulation path, is provided at a location of the carrier liquid circulation device located outside the electronic photograph printer.

12. An electronic photograph printer comprising the transfer roller cleaning apparatus according to claim 11.

13. An electronic photograph printer comprising the transfer roller cleaning apparatus according to claim 8.

14. The transfer roller cleaning apparatus according to claim 1, wherein the pump of the carrier liquid circulation device and the storage tank are placed outside the electronic photograph printer, and a filter, which removes contaminants from the carrier liquid flowing through the carrier liquid circulation path, is provided at a location of the carrier liquid circulation device located outside the electronic photograph printer.

15. An electronic photograph printer comprising the transfer roller cleaning apparatus according to claim 14.

16. The transfer roller cleaning apparatus according to claim 1, further comprising:

a cassette that is configured by providing the supply roller, the cleaning roller, the carrier liquid vessel, and an overflow liquid storing portion that causes the carrier liquid overflowed from the carrier liquid vessel in the overflow liquid recovery path to flow in a cassette frame, and is attached to a body of the electronic photograph printer in an attachable and detachable manner, and wherein a cassette side flow path portion of the carrier liquid circulation device provided in the cassette and an external flow path portion located outside the cassette are connected to each other using a one-touch coupler in an attachable and detachable manner.

17. An electronic photograph printer comprising the transfer roller cleaning apparatus according to claim 16.

18. The transfer roller cleaning apparatus according to claim 1, wherein, when a peripheral speed of the transfer roller is set to 100, a peripheral speed of the cleaning roller that is rotated with the transfer roller in a forward direction is 25 to 40, and, when a peripheral speed of the cleaning roller is set to 100, a peripheral speed of the carrier liquid supply roller that is rotated with the cleaning roller in the forward direction is 60 to 80.

19. An electronic photograph printer comprising the transfer roller cleaning apparatus according to claim 18.

20. An electronic photograph printer comprising the transfer roller cleaning apparatus according to claim 1.

* * * * *

UNITED STATES PATENT AND TRADEMARK OFFICE

CERTIFICATE OF CORRECTION

PATENT NO. : 8,953,972 B2
APPLICATION NO. : 13/675093
DATED : February 10, 2015
INVENTOR(S) : Hideo Izawa et al.

It is certified that error appears in the above-identified patent and that said Letters Patent is hereby corrected as shown below:

On the title page item (73), delete "KEIHIN CORPORATION" and insert -- MIYAKOSHI PRINTING MACHINERY CO., LTD. --

Signed and Sealed this
Twenty-sixth Day of May, 2015

Michelle K. Lee

Michelle K. Lee
*Director of the United States Patent and Trademark Office*